US006811526B2

(12) United States Patent
Jansen

(10) Patent No.: US 6,811,526 B2
(45) Date of Patent: Nov. 2, 2004

(54) FOLDING-BOX GLUING OR ADHESIVE-BONDING MACHINE WITH AN EJECTOR OR REMOVAL DEVICE

(75) Inventor: Frank Jansen, Krefeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/455,052

(22) Filed: Jun. 5, 2003

(65) Prior Publication Data

US 2004/0033875 A1 Feb. 19, 2004

(30) Foreign Application Priority Data

Jun. 5, 2002 (DE) ..... 102 24 814

(51) Int. Cl.[7] ..... B31B 1/14
(52) U.S. Cl. ..... 493/82; 493/83; 493/373
(58) Field of Search ..... 493/82, 83, 373, 493/475, 478, 479, 471

(56) References Cited

U.S. PATENT DOCUMENTS

| | | | | | |
|---|---|---|---|---|---|
| 4,033,240 | A | * | 7/1977 | Deslauriers | 493/373 |
| 4,213,378 | A | * | 7/1980 | Rossollin | 493/373 |
| 4,566,582 | A | | 1/1986 | Linder | |
| 5,087,237 | A | * | 2/1992 | Nunley | 493/342 |
| 5,197,938 | A | * | 3/1993 | Chmielewski | 493/373 |
| 5,215,516 | A | * | 6/1993 | Stutt | 493/365 |
| 5,219,108 | A | * | 6/1993 | Mineki | 225/99 |
| 5,342,278 | A | * | 8/1994 | Kurandt | 493/16 |
| 5,502,951 | A | * | 4/1996 | Oliverio et al. | 53/455 |
| 5,636,559 | A | * | 6/1997 | Smithwick et al. | 83/116 |
| 6,602,007 | B1 | * | 8/2003 | Majus | 400/616 |

FOREIGN PATENT DOCUMENTS

| | | |
|---|---|---|
| CH | 659 053 A5 | 12/1986 |
| DE | 41 29 612 A1 | 3/1993 |
| DE | 297 02 326 U1 | 5/1997 |
| DE | 100 01 556 A1 | 7/2000 |
| DE | 199 48 017 A1 | 4/2001 |
| WO | 01/24998 A1 | 4/2001 |

* cited by examiner

*Primary Examiner*—Eugene Kim
(74) *Attorney, Agent, or Firm*—Laurence A. Greenberg; Werner H. Stemer; Ralph E. Locher

(57) ABSTRACT

A folding-box gluing or adhesive-bonding machine for producing folding boxes from blanks includes a folding station for folding parts of the blanks provided with a strip of adhesive. An adjoining transfer station includes at least two pairs of conveyor belts acting as a conveying device, a device for removing faulty folding boxes including a circular knife for cutting in a longitudinal conveying direction of the folding boxes and being lowered and lifted between the conveyor belts into and out of a conveying plane, and a device for laterally withdrawing side parts of the blanks severed by the longitudinal cut. The laterally withdrawing device has a flat rotary table outside and immediately adjacent one of the pairs of conveyor belts, an electric motor and at least two pressure disks. A collecting and pressing device presses the boxes having been folded flat, to set the adhesive.

11 Claims, 3 Drawing Sheets

FOLDING-BOX GLUING OR ADHESIVE-BONDING MACHINE WITH AN EJECTOR OR REMOVAL DEVICE

BACKGROUND OF THE INVENTION

Field of the Invention

The invention relates to a folding-box gluing or adhesive-bonding machine for producing folding boxes from blanks. The machine includes a folding station at which parts of the blank parts, which have been provided with a strip of adhesive, are folded. An adjoining transfer station has at least two pairs of conveyor belts as a conveying device respectively including an upper and a lower belt. A device is provided for removing or ejecting faulty folding boxes. The removing device includes a circular knife for cutting in a conveying direction of the folding boxes and is mounted at a starting location of the transfer station so as to be lowerable between the two pairs of conveyor belts into a conveying plane of the folding boxes, and liftable from the conveying plane. A device is disposed on respective elongated sides of the transfer station for laterally withdrawing side parts of the blanks severed by the longitudinal cut. A collecting and pressing device presses the boxes, which have been folded flat, for effecting a setting of the adhesive.

The removing device in the transfer station serves for removing boxes detected as being faulty upstream from the collecting and pressing device, before an overlapping stream of the boxes is produced at the start of the collecting and pressing device. Due to the transfer station, the boxes continue to be conveyed individually and at a spaced distance from one another, so that an individual box can be pulled out or withdrawn without any detrimental effect upon the preceding and succeeding boxes. Faulty boxes are boxes which are not adequately glued or adhesively bonded, boxes which contain folding faults or boxes which, during an identity check, have been detected as not belonging to the job.

A removal device of that general type for separating out flat objects under control has become known heretofore from German Patent DE 41 29 612 C2. The device described therein has a marking station, wherein the folding boxes are automatically displaced laterally. The folding boxes are then disposed so as to overlap one another, and conveyed onwardly. The folding boxes which have been displaced laterally by the marker project laterally beyond the overlapping stream and are gripped by a rotary table and rollers running thereon and are torn from the overlapping stream, without disrupting the remaining overlapping stream.

In German Published, Non-Prosecuted Patent Application DE 199 48 017 A1, a folding-box gluing machine is described which includes a folding station, an adjacent transfer station and a collecting and pressing device. The transfer station has a removal device including a circular knife for cutting up the faulty folding boxes and a device for withdrawing or pulling out the folding-box parts. The circular knife is mounted at the start of the transfer station so as to be lowerable between the two pairs of conveyor belts into the conveying plane of the folding boxes, and liftable from the plane. The folding boxes can be divided in the conveying direction with the aid of the circular knife. A device which is disposed on each long side of the transfer station, for withdrawing or pulling out laterally the side parts severed by the longitudinal cut, is also included. Each of the pull-out or withdrawal devices has a belt conveyor, which extends from outside through a cutout in the upper roller rail to as far as the vicinity of the conveyor belt. The conveying direction of each belt conveyor runs outwardly inclined approximately at an angle of 45° opposite to the conveying direction of the pairs of belts above a smooth table, which is fixed to the outside of the roller cheek or frame. The front deflection roller of the belt conveyor can be raised and lowered by a pneumatic piston-cylinder unit. When the deflection roller is lowered onto a folding-box part projecting outwardly beyond the conveyor belts, the belt draws or pulls the folding-box part outwardly over the table and removes it from the machine.

Heretofore known devices for withdrawing or pulling out, i.e., ejecting, with which a folding box is withdrawn or pulled out to one side between the pairs of conveyor belts, cannot be used when pressure rollers are employed for large box widths or, as belt conveyors, can only exert forces of insufficient strength on the folding boxes.

SUMMARY OF THE INVENTION

It is accordingly an object of the invention to provide a folding-box gluing or adhesive-bonding machine with an ejector or removal device, which overcomes the hereinafore-mentioned disadvantages of the heretofore-known devices of this general type and in which folding boxes detected as being faulty can be gripped reliably and removed at high speed.

With the foregoing and other objects in view, there is provided, in accordance with the invention, a folding-box gluing or adhesive-bonding machine for producing folding boxes from blanks. The machine comprises a folding station at which parts of the blanks that have been provided with a strip of adhesive, are folded. An adjoining transfer station has at least two pairs of conveyor belts as a conveying device, respectively including an upper and a lower belt. A device for removing or ejecting faulty folding boxes includes a circular knife for cutting in a longitudinal conveying direction of the folding boxes and is mounted, at a starting location of the transfer station, so as to be lowerable between the two pairs of conveyor belts into a conveying plane of the folding boxes, and liftable from the conveying plane. A device is disposed on respective long sides of the transfer station for laterally withdrawing side parts of the blanks severed by the longitudinal cut. A collecting and pressing device presses the boxes, which have been folded flat, for setting the adhesive. The device for laterally withdrawing the severed side parts further includes a flat rotary table continuously revolvable at high speed. The rotary table is disposed outside and immediately adjacent one of the pairs of conveyor belts. An electric motor drives the rotary table. At least two pressure disks are disposed after one another, in running direction of the folding box blanks, downstream from the center of the rotary table and at an outer rim of the rotary table.

In accordance with another feature of the invention, the pressure disks are provided with a toothing in the form of gear wheels.

In accordance with a further feature of the invention, the machine further includes a two-sided lever at respective ends of which the pressure disks are freely rotatably mounted. The two-sided lever is tiltably fixed centrally.

In accordance with an added feature of the invention, the machine further includes a stop for adjusting spacing between the rotary table and the pressure disks.

In accordance with an additional feature of the invention, the machine further includes another circular knife respectively disposed inside adjacent the pairs of conveyor belts.

In accordance with yet another feature of the invention, the circular knife is freely rotatably mounted.

In accordance with yet a further feature of the invention, the machine further includes a housing wherein the circular knife is liftably and lowerably mounted. The housing is fixed to a lateral roller rail of the transfer station.

In accordance with yet an added feature of the invention, the housing is at least one of adjustable vertically and swivelable outwardly over the roller rail.

In accordance with yet an additional feature of the invention, the machine further includes one of a pot-shaped knife and a roller opposing the circular knife. The circular knife is movable downwardly against the one of the pot-shaped knife and the opposing roller for cutting, so as to produce a shearing cut.

In accordance with a concomitant feature of the invention, the machine includes guide plates respectively disposed inside and adjacent the pairs of conveyor belts. The guide plates are swivellable into a path of movement of the severed side parts and, in the running direction of the folding-box blanks, are aligned obliquely outwardly.

The object of the invention is thus achieved by the device for withdrawing or pulling out laterally the severed side parts, which includes a flat rotary table revolvable continuously at high speed, driven by an electric motor, and disposed immediately adjacent the conveyor belts, and at least two pressure disks which, in the running direction, are disposed one after another downstream of the center and at the outer rim of the rotary table. Placing a circular knife at the start of the transfer station and the device for withdrawing or pulling out laterally by a rotary table in the center of the transfer station, provide for gripping the divided folding boxes reliably, and withdrawing or pulling them out at high speed between the pairs of belts.

In a particularly advantageous configuration according to the invention, wherein the pressure disks are constructed as flat gear wheels, the reliability of gripping the folding-box parts is again increased. The use of a toothed disk also offers the advantage that a form-locking connection is produced between the toothed disks and the folding-box parts. Due to the form-locking connection, the folding-box parts are forced in one direction. By setting the distance between the rotary table and the flat gear wheels, the form-locking connection can be adapted individually to the respective thickness of the folding-box materials, and therefore the tensile force, when withdrawing or pulling out the folding-box parts, can be influenced. The tensile force produced via the form-locking connection of the flat gear wheels is, however, always greater, in this regard, than a force-locking connection between the pairs of conveyor belts.

Other features which are considered as characteristic for the invention are set forth in the appended claims.

Although the invention is illustrated and described herein as embodied in a folding-box gluing or adhesive-bonding machine with an ejector device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
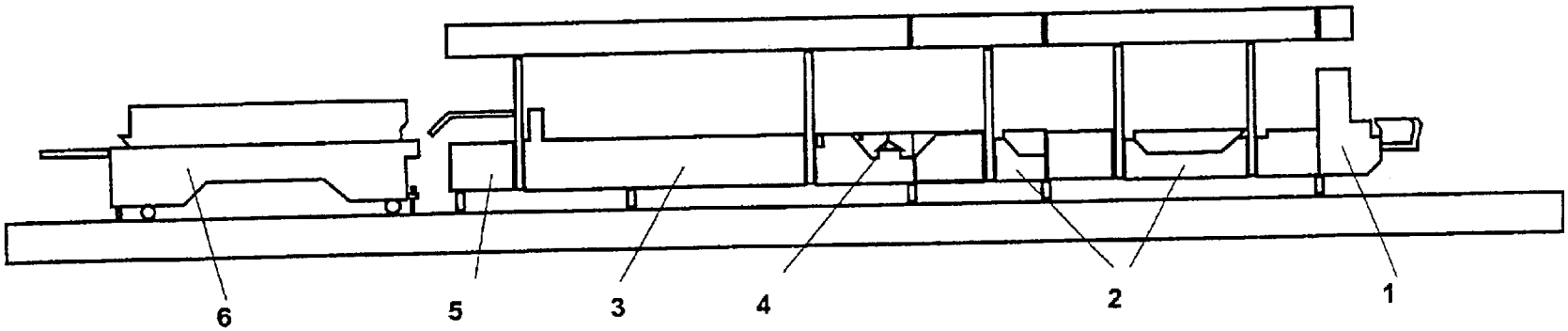
FIG. 1 is a diagrammatic, side-elevational view of a folding-box gluing machine, showing individual stations thereof.

Referring now to the figures of the drawings in detail and first, particularly, to FIG. 1 thereof, there is seen, in a conveying direction of a folding-box blank from the right-hand side to the left-hand side of the figure, a folding-box machine according to the invention which begins with a feeder 1 that draws the blanks to be processed from a stack or pile thereof successively at high speed and feeds them individually to following processing stations. The feeder 1 is followed by a pre-breaker 2 which, in the exemplary embodiment at hand, has a two-stage construction. The pre-breaker 2 includes folding elements for forwardly and backwardly folding folding tabs so that the corresponding longitudinal crease lines can be made soft and supple by being bent through °. The two-stage embodiment permits the breaking of more longitudinal and transverse creases and the performance of additional folding actions. With regard to specific folding-box shapes, two adhesive or glue applicator units are already disposed inside the pre-breaker in order to apply additional adhesive or glue strips in the longitudinal direction to the folding-box blanks. The pre-breaker 2 is followed by a folding station 3 as the next processing station, at the starting end of which an applicator unit 4 for adhesive, usually glue, is disposed. The glue applicator unit 4 has glue nozzles or glue disks, from which the adhesive or glue is applied in strip form to the folding-box blanks. Before the folding tabs of the blanks, which have been provided with the glue or adhesive strip, are folded by folding elements, the glue or adhesive strip that has been applied is inspected. For this purpose, the glue or adhesive strip is scanned without contact by a so-called adhesive or glue-loading inspection device. If the glue or adhesive strip does not have the required quality, a report is made to a central control unit that the folding box is flawed or faulty.

The folding boxes are checked for folding faults at the end of the folding station 3. For this purpose, photocells are disposed in this region, by which the folding box length is scanned. If the length of one of the folding boxes does not correspond to the predefined format, for example because a tab has not been folded properly, then this box is also reported to the central control unit of the folding-box gluing machine as being faulty.

Figure 2:
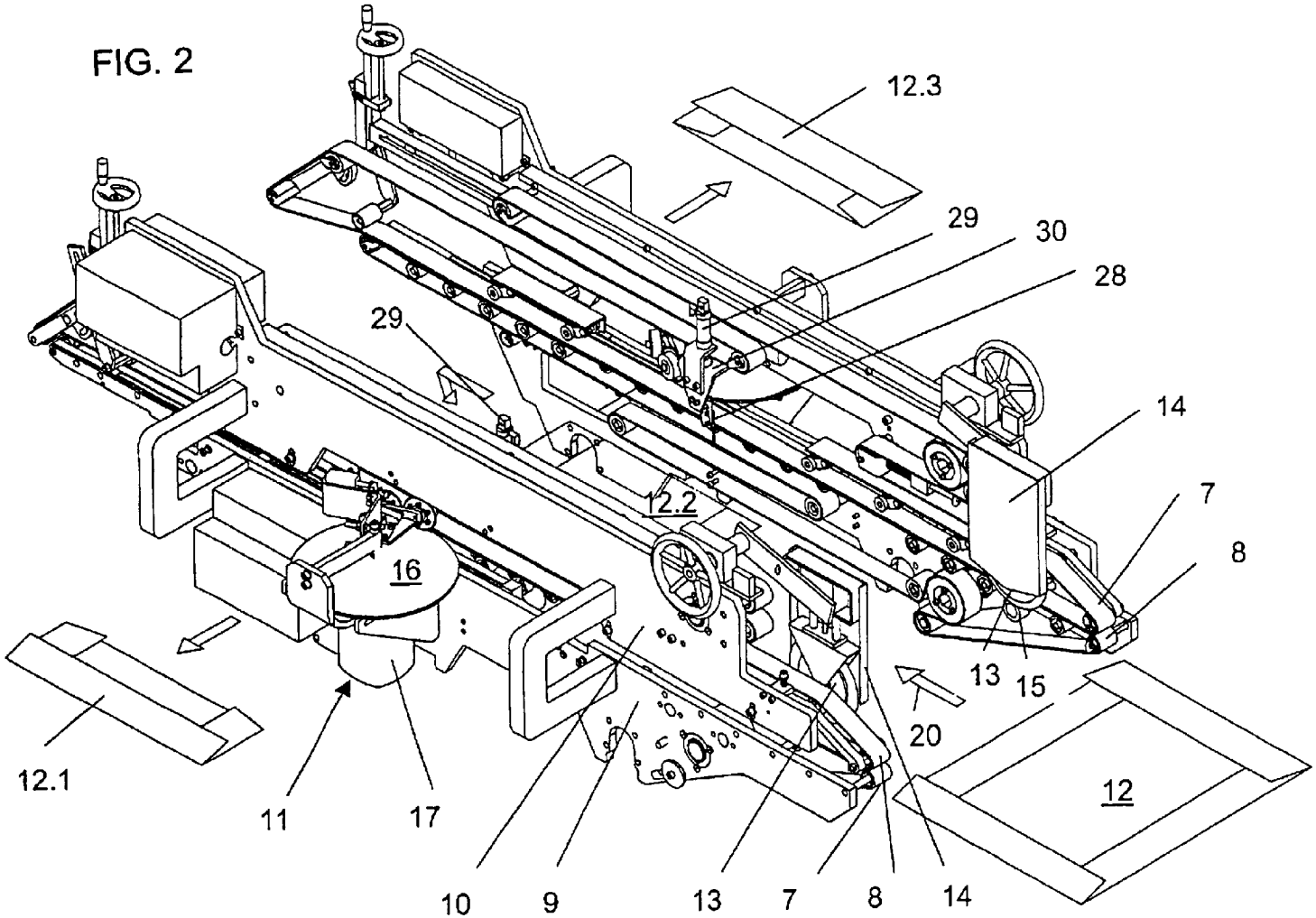
FIG. 2 is a top, side and end perspective view of part of the transfer station with a removal or ejector device associated therewith.

The folding station 3 is immediately followed by a transfer station 5, shown in an enlarged view in FIG. 2. The transfer station has as its primary task the supplying of the folded folding boxes, provided with glue or adhesive seams, with all parts aligned, to a following collecting and pressing device 6. An overlapping stream of folded boxes 12 is produced at a transition from the transfer station 5 to the collecting and pressing device 6. The collecting and pressing device 6 has pressing belts, by which the glue or adhesive seams are held under pressure until the adhesive has set securely.

The transfer station 5 in FIG. 2 includes two pairs of belts 7 and 8 extending spaced from and parallel to one another, in the conveying direction, as a conveying device for the folding boxes. Each pair of belts includes a lower belt 7 and an upper belt 8. The folded-box blanks are conveyed at a spaced distance from one another between the upper run of the lower belts 7 and the lower run of the upper belts 8 and, in the process, the upper belts 8 hold down turned-over side tabs of the blanks. The pairs of conveyor belts 7 and 8 must be capable of being positioned transversely in order to adapt them to different blank widths. For this purpose, each of the lower conveyor belts 7 is mounted on a roller jaw 9 extending in the conveying direction and suspended in the machine frame so as to be positionable transversely by an adjusting spindle. Each upper conveyor belt 8 is accordingly mounted on a so-called roller rail 10 thereof, which is respectively displaced in synchronism with the roller jaw 9 assigned thereto, in order to set or adjust the belts 7 and 8 to the desired operating position. The belts 7 and 8 are driven by a central drive of the folding-box gluing machine.

A removal device in the transfer station 5 includes a circular knife 13 for dividing the folding boxes 12, a swivelling device 30 for swivelling guide plates 28 into a path of movement or travel of the folding boxes 12, and a device 11 for laterally withdrawing folding-box parts 12.1 and 12.3.

At least one circular knife 13 is disposed at a starting location of the transfer station 5, between the two pairs of conveyor belts 7 and 8 for cutting in the conveying direction. The circular knife 13 is mounted in a frame of the transfer station 5 so that it can be lowered into the conveying plane of the boxes 12 for the purpose of cutting, and can be raised from the conveying plane for inactivating it.

It is preferable for two identically constructed circular knives 13 to be respectively disposed within an adjacent pair of conveyor belts 7 and 8, for the purpose of dividing a faulty box 12 into three parts 12.1, 12.2 and 12.3.

The circular knives 13 are preferably freely rotatably mounted in a protective housing 14 and, for the purpose of cutting, are moved downwardly against a respective opposing roller 15. Each opposing roller 15 extends from below circumferentially to as far as the height of the upper, conveying or taut length of the lower conveyor belt 7 and, thereby, supports a box 12 from below during cutting. In this regard, the circular knife is moved a distance downwardly so that the cutter thereof is located below the surface of the opposing pressure roller, thereby producing a shearing cut. The folding boxes 12 are consequently divided or separated completely. It is likewise conceivable to provide a pot-shaped knife instead of the opposing roller, in order to be able to set or adjust the shearing force of the cutting unit 13, 15 to different folding-box materials.

Figure 3:
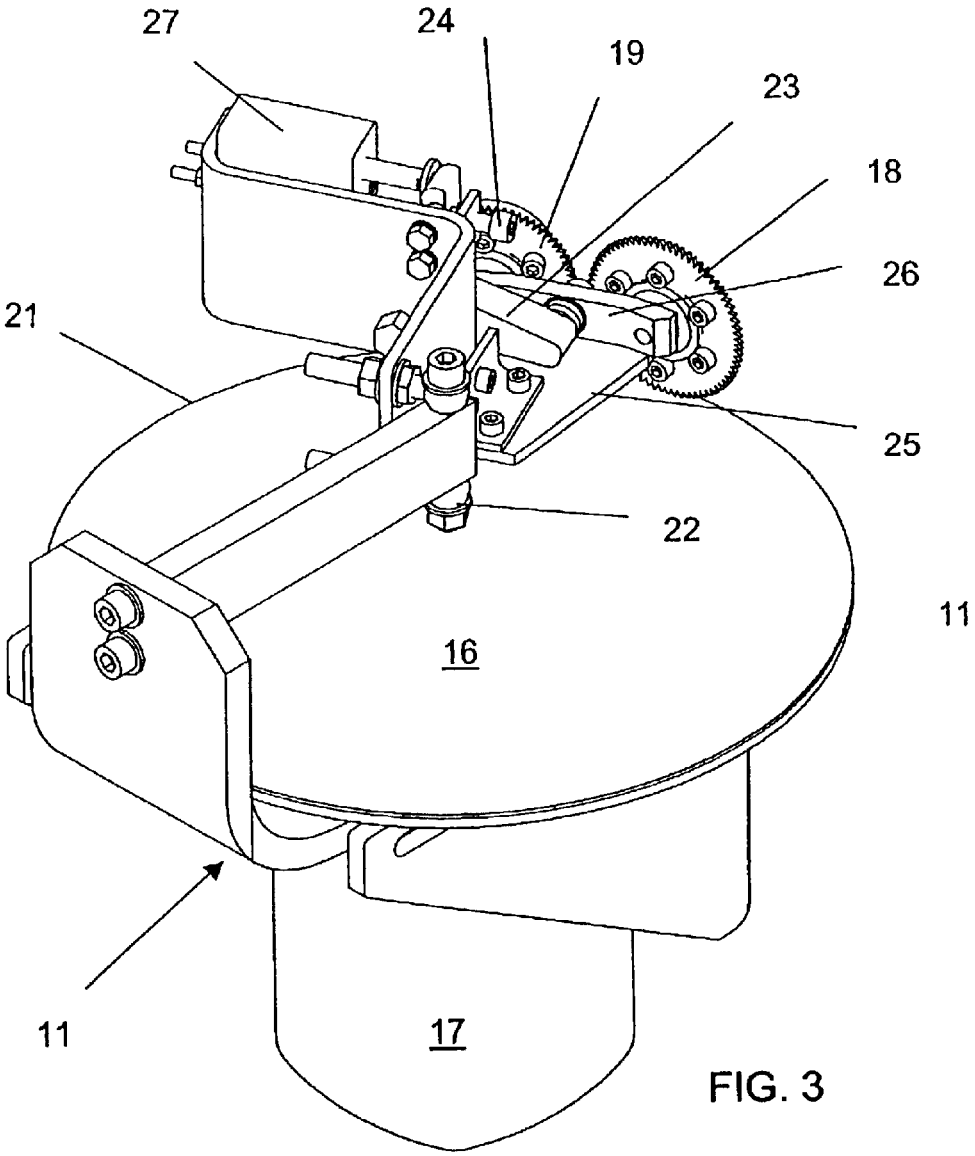
FIG. 3 is an enlarged, fragmentary, perspective view of FIG. 2, showing in greater detail the removal device for laterally withdrawing severed side parts of the folding-box blank.

A device 11 for laterally withdrawing or pulling the side parts 12.1 and 12.3, which have been severed at the longitudinal cut, from the machine, is disposed at a distance downstream from the circular knives 13, in the conveying direction, on each long side of the transfer station 5. Each of the pulling or withdrawing devices 11, as shown more clearly in the enlarged view of FIG. 3, includes a flat rotary table 16, revolving continuously at high speed. The respective rotary table 16 is driven by an electric motor 17 and is disposed, as shown in FIG. 2, immediately outside and adjacent the pairs of conveyor belts 7 and 8. The rotary table 16 of the pulling device 11 is, in this regard, made of metal or plastic material. It may, however, also be formed of metal having a plastic covering. It is likewise conceivable to apply a coating, such as of an alloy containing molybdenum, to a metal plate. Furthermore, the pulling device 11 has at least two pressure disks 18 and 19 which, in a running or travel direction 20 of the box blanks 12, are disposed after one another downstream from the center and at an outer rim of the rotary table 21. An angle between the pressure disks 18 and 19 and the pairs of conveyor belts 7 and 8 can be adjusted or set via a rotary joint 22 in a holding device for the pressure disks 18 and 19. The first pressure disk 18, as viewed in the conveying direction 20, is aligned outwardly inclined at an acute angle opposite to the conveying direction of the pairs of belts 7 and 8. The second pressure disk 19, as viewed in the running or conveying direction 20, is set at a greater angle, of about 45°, to the conveying direction of the pairs of belts 7 to 8. The pressure disks 18 and 19 are freely rotatably mounted. In this regard, the distance between the rotary table 16 and the pressure disks 18 and 19 can be adjusted or set by an angular lever 23 and an adjusting screw 24 assigned thereto. The pressure disks 18 and 19 are not in engagement with or resting on the rotary table 16. A two-sided lever 26 is held in parallel therewith above the rotary table 16 by a stop 25, in order to accommodate the freely rotatably mounted pressure disks 18 and 19. A necessary pressure opposing the stop 25 is produced by a spring element 27.

As further illustrated in FIG. 2, respective guide plates 28 are disposed downstream from the circular knives 13 and upstream from the pulling device 11, in the running or travel direction 20 of the box blanks 12. The guide plates 28 are disposed on the inside near the pairs of conveyor belts 7 and 8, and are swivellable into the travel or movement path of the severed side parts 12.1 and 12.3. The guide plates 28 are driven by a pneumatic cylinder 29, and swivel in a direction opposite to the travel or running direction 20 into the path of movement or travel of the folding boxes 12. The guide plates 28 extend downwardly beyond the conveying plane and run obliquely outwardly in the conveying direction 20. The guide plates 28 effect a thrust against the cutting edge of the folding-box parts 12.1 and 12.3 in outward direction, so that the folding-box parts 12.1 and 12.3 come into the range of engagement of the pulling device 11. The guide plates 28 are swivelled out of the path of movement or travel of the folding boxes 12 in the running direction 20 again after the removal of a respective one of the folding-box parts 12.1 and 12.3.

FIG. 2 illustrates a preferred embodiment of a transfer station having two knives 13, two swivelling devices 30 for inwardly swivelling the guide plates 28, and two withdrawal or pulling devices 11. If a folding box 12 is detected as being faulty, the central control unit of the folding-box gluing or adhesive-bonding machine determines the instant of time at which this folding box 12 runs into the transfer station 5. After a preceding fault-free folding box has passed the circular knives 13, the circular knives 13 are lowered and, as the faulty folding box 12 runs through, cut it up into three parts 12.1, 12.2 and 12.3. If a fault-free folding box follows, the circular knives 13 are raised upwardly again into the inactive position thereof above the conveying plane immediately after the faulty folding box 12 has passed.

Lowering the circular knife 13 beyond the diameter of the opposing roller 15 ensures that the folding boxes 12 are divided completely. With an appropriate delay, the two swiveling devices 30 are then activated, and the guide plates 28 are swiveled into the path of movement of the folding-box parts 12.1 and 12.3. Due to the guide plates 28, the folding-box parts 12.1 and 12.3 receive an outward momentum or impulse, so that they pass into the region of engagement of the pulling device 11. The folding-box parts 12.1 and 12.3 are gripped by the rotary table 16 of the pulling device 11.

The folding-box parts 12.1 and 12.3 are clamped and form-lockingly connected or gripped between the pressure disks 18 and 19, on the one hand, and the rotary table 16, on the other hand. A form-locking connection is one which connects two elements together due to the shape of the elements themselves, as opposed to a force-locking connection, which locks the elements together by force external to the elements. The stop 25 thus prevents tilting of the pressure disks 18 and 19, which are movably mounted at the ends of the two-sided lever 26. As the respective folding-box part 12.1, 12.3 arrives under the first pressure disk 18, a torque is exerted on the two-sided lever 26, and the torque tends to force the second pressure disk 19 onto the rotary table 16. However, the stop 25 prevents the two-sided lever 26 from tilting, so that only the pressure disk 18 acts against the respective folding-box part 12.1, 12.3 with the force of the spring 27. Also the further engagement of the second pressure disk 19 cannot cause any tilting of the lever or carrying arm 26, because the stop 25 counteracts any tilting. While the folding-box parts 12.1 and 12.3 are being withdrawn or pulled out, the toothed pressure disks 18 and 19 act form-lockingly on the folding-box parts 12.1 and 12.3. Slipping or displacement of the folding-box parts 12.1 and 12.3 between the pressure disks 18 and 19, on the one hand, and the rotary table 16, on the other hand, is thus ruled out. The folding-box parts 12.1 and 12.3 can thus be gripped securely and removed in a defined manner via the adjustable speed of the rotary table 16. The speed of the removal action can be varied and set via the rotational speed of the rotary table 16, on the one hand, and the angle thereof can be varied and set via the number of pressure disks 18 and 19, on the other hand. It is thus also conceivable to place more than two pressure disks 18 and 19 on the rotary table 16, in order to have an affect on or influence, in this manner, the direction in which the folding-box parts 12.1 and 12.3 are removed.

I claim:

1. A folding-box gluing or adhesive-bonding machine for producing folding boxes from blanks, the machine comprising:

a folding station for folding parts of the blanks provided with a strip of adhesive;

a transfer station adjoining said folding station, said transfer station having a starting location and long sides, said transfer station including:

at least two pairs of conveyor belts acting as a conveying device, said conveyor belts each having an upper and a lower belt;

a device for removing faulty folding boxes, said removing device including a circular knife for cutting in a longitudinal conveying direction of the folding boxes, said circular knife being mounted at said starting location and being configured to be lowered between said two pairs of conveyor belts into a conveying plane of the folding boxes and to be lifted from the conveying plane; and a device disposed on said respective long sides of said transfer station for laterally withdrawing side parts of the blanks severed by a longitudinal cut, said laterally withdrawing device including:

a flat rotary table for continuously revolving at high speed and having a center and an outer rim, said rotary table being disposed outside of said convey device and immediately adjacent one of said pairs of conveyor belts;

an electric motor for driving said rotary table; and at least two pressure disks disposed after one another, in the longitudinal conveying direction of the folding box blanks, downstream from said center and at said outer rim of said rotary table; and a collecting and pressing device for pressing the boxes having been folded flat, to set the adhesive.

2. The machine according to claim 1, wherein said pressure disks have a toothing in the form of gear wheels.

3. The machine according to claim 1, further comprising a two-sided lever having ends and being fixed centrally for tilting, said pressure disks being freely rotatably mounted at said respective ends.

4. The machine according to claim 3, further comprising a stop for adjusting a spacing between said rotary table and said pressure disks.

5. The machine according to claim 1, further comprising another circular knife disposed inside and adjacent said pairs of conveyor belts.

6. The machine according to claim 1, wherein said circular knife is freely rotatably mounted.

7. The machine according to claim 1, wherein said transfer station has a lateral roller rail, said circular knife has a housing, said circular knife is mounted in said housing for lifting and lowering, and said housing is fixed to said lateral roller rail.

8. The machine according to claim 7, wherein said housing is at least one of vertically adjustable and outwardly pivotable over said roller rail.

9. The machine according to claim 1, further comprising a pot-shaped knife opposing said circular knife, said circular knife being movable downwardly against said pot-shaped knife for cutting to produce a shearing cut.

10. The machine according to claim 1, further comprising a roller opposing said circular knife, said circular knife being movable downwardly against said opposing roller for cutting to produce a shearing cut.

11. The machine according to claim 1, further comprising guide plates respectively disposed inside and adjacent said pairs of conveyor belts for swiveling said guide plates into a path of movement of the severed side parts and aligning said guide plates obliquely outwardly, in the longitudinal conveying direction of the folding-box blanks.

* * * * *